United States Patent [19]

Hart et al.

[11] 4,041,583

[45] Aug. 16, 1977

[54] YARN TEXTURING JET

[75] Inventors: Marvin Sumner Hart, Wilmington, Del.; William James Powers, Jr., North East, Md.

[73] Assignee: E. I. Du Pont de Nemours and Company, Wilmington, Del.

[21] Appl. No.: 688,247

[22] Filed: May 20, 1976

[51] Int. Cl.[2] ..... D02G 1/16

[52] U.S. Cl. ..... 28/254; 28/272; 28/273

[58] Field of Search ..... 28/1.4, 254, 272, 273; 226/97

[56] References Cited

U.S. PATENT DOCUMENTS

| | | | |
|---|---|---|---|
| 2,982,082 | 5/1961 | Pool | 28/1.4 X |
| 3,545,057 | 12/1970 | Lubach | 28/1.4 |
| 3,577,614 | 5/1971 | Price | 28/1.4 |
| 3,823,450 | 7/1974 | Ankudowicz et al. | 28/1.4 |
| 3,835,510 | 9/1974 | Koslowski | 28/1.4 |
| 3,863,309 | 2/1975 | Price | 28/1.4 |
| 3,881,231 | 5/1975 | Price et al. | 28/1.4 |
| 3,881,232 | 5/1975 | Price et al. | 28/1.4 |
| 3,892,020 | 7/1975 | Koslowski | 28/1.4 X |

FOREIGN PATENT DOCUMENTS

| | | | |
|---|---|---|---|
| 47-51664 | 12/1972 | Japan | 28/272 |

*Primary Examiner*—Robert R. Mackey

[57] ABSTRACT

A self stringing jet device for fluid texturing yarn having a yarn needle slidably mounted in the jet body for movement from a preset operating position to a stringup position and back to the preset operating position wherein the pressure of the fluid returns the yarn needle to the preset operating position from the stringup position.

1 Claim, 5 Drawing Figures

YARN TEXTURING JET

BACKGROUND OF THE INVENTION

This invention relates to air texturing of yarn and, more particularly, to improvements in a fluid jet apparatus used to texture the yarn.

Fluid jet apparatus for texturing yarn usually comprises a conically-tipped yarn guiding tube or needle for introducing yarn into the apparatus, a port for supplying pressurized fluid to a space surrounding the forward end of the needle and a venturi-shaped nozzle through which yarn and fluid leave the jet. Yarn is usually introduced into such a jet by moving the forward end of the yarn needle close to the converging entrance of the nozzle so that the flow of pressurized fluid is severely throttled between the two, producing an air pressure less than atmospheric at the forward end of the needle. This induces an inward flow of atmospheric air through the needle which will draw an end of yarn into and through the jet. This aspirating (stringup) position, however, generally does not permit sufficient fluid to pass through the jet to give optimum yarn texturing action. Therefore, the gap between the forward end of the yarn needle and the nozzle entrance is usually increased, i.e, the needle is moved back to some preset operating position, to provide optimum yarn texturing action.

Jets have been made in the past which are adjustable between fixed positions for stringup and operating conditions but these include mechanical assists such as springs to effect adjustments and as a consequence the manufacturing costs of such jets are high.

SUMMARY OF THE INVENTION

It has now been found that a jet apparatus for fluid texturing yarn can be made easily stringable by having the yarn needle slidably mounted on the jet body for movement from a preset operating position to a stringup position and back to the preset operating position. A piston and cylinder structural relationship between the yarn needle and the jet body permits the use of pressurized fluid to return the yarn needle from a stringup to a preset operating position.

The yarn texturing jet includes a body having yarn inlet and outlet ends connected by a central bore, means for introducing pressurized gas through a gas inlet into said bore between said ends, a venturi located in said bore at said outlet end, and a yarn needle extending into said bore from the yarn inlet end of the body. The yarn needle has a passage therethrough for guiding yarn from the yarn inlet of the body past the gas inlet through the exit end of the needle to the venturi. The needle has a cylindrical portion thereon approximating the diameter of the bore which extends beyond said gas inlet and terminates in a surface facing and spaced from said venturi. There is an orifice in this portion in communication with the gas inlet and exiting at said surface for directing pressurized gas from the gas inlet into the venturi. The improvement comprises that the guiding element is axially slidable in said body from a preset operating position to a stringup position back to said preset operating position and is attached to a flange located outside the body at the inlet end of the body. There is provided means for limiting movement of said flange away from the inlet end of the body to said preset operating position and a reduced region in the cylindrical portion on said yarn guiding element in communication with the pressurized gas means and the orifice both in said stringup position and in said preset operating position whereby pressurized gas returns the yarn guiding element to said preset operating position from said stringup position.

DETAILED DESCRIPTION OF THE DRAWING

Figure 1:
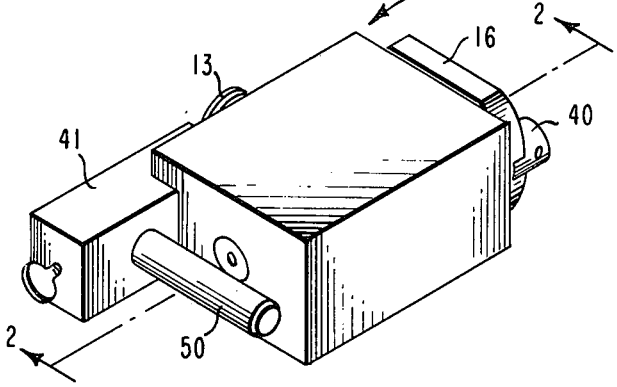
FIG. 1 is a perspective view of a preferred embodiment of the invention with a baffle fixed with relation to the outlet end of the jet.
Figure 4:
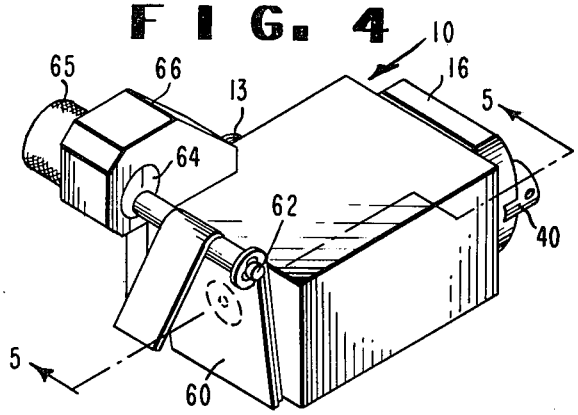
FIG. 4 is a perspective view of a preferred embodiment of the invention with a baffle free to seek a force balance position with respect to the outlet end of the jet.

Referring now to the drawing, the devices shown in FIGS. 1 and 4 have a common yarn texturing jet 10 each with a different baffle arrangements at its outlet end. The jet 10 includes as components, a body member 12 having a central bore 14, a gas inlet 13 leading into the bore 14 intermediate its ends, a flange 16 located outside the body 12 at the yarn inlet end of the body, a venturi 18 located in the bore 14 at the outlet end of the body, and a yarn guiding element (commonly referred to as a yarn needle in the trade) 20 fixed to the flange 16 and having a passage 22 therethrough for guiding yarn 11 from the yarn inlet 15 of the jet past the gas inlet 13 through the exit end 17 of the yarn needle to the venturi 18. The flange 16 has a counterbored hole **16*a* through one side which is adapted to freely receive bolt 40. Bolt 40 threads into body 12 and abuts against the shoulder of the counterbore of hole 16*a* to serve as a stop for the movement of yarn needle 20 out of bore 14, i.e., serves as a means for limiting movement of the flange 16 away from the inlet end of the body 12. The outer diameter of yarn needle 20 which approximates the inside diameter of bore 14 is reduced in the region opposite the gas inlet 13 which in conjunction with an annular groove in the body at the same location provides an annular plenum chamber 24, following which is a cylindrical portion 30 with an outer diameter approximately equal to the inside diameter of the bore 14 located beyond gas inlet 13. Cylindrical portion 30 has an orifice 32 through it exiting at the surface 31 facing the venturi 18. The forward portion 26 of the yarn needle 20 consists of another portion of reduced diameter which tapers at an included angle of preferably about 60° to exit end 17 which contains a sapphire insert 51 to improve the wear resistance of the exit end of the needle. Venturi 18 has a converging conical entrance 19 with an included angle of preferably about 60° leading to its exit passage 21 which may be a constant diameter cylindrical bore or preferably may have a short cylindrical portion followed by a conical portion which diverges toward the outlet end of the jet at an included angle of about 7°. The tapering surface on the end of element 20 and the conical entrance 19 of the venturi form an annular restriction between them designated B. Between cylindrical portion 30 and the upstream end of converging conical entrance 19 to venturi 18 is an annular chamber 35.**

The axis of orifice 32 is preferably parallel to the axis of yarn needle 20, degrees of skewness being particularly harmful since they introduce unidirectional swirls which can twist the yarn and prevent the filaments from spreading apart to receive maximum texturing. However, the axis of orifice 32 may intersect the axis of yarn needle 20 if desired.

Figure 2:
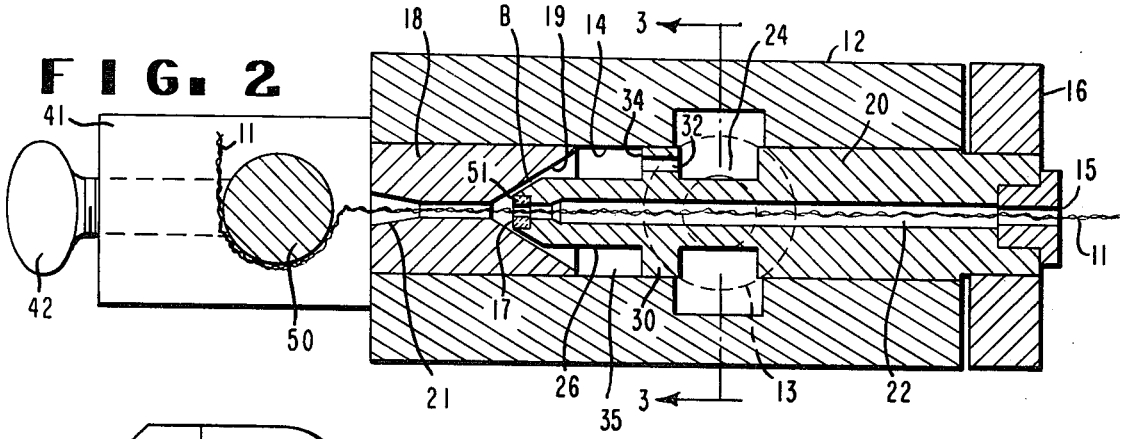
FIG. 2 is an enlarged section of FIG. 1 taken along line 2—2.

FIG. 2 shows a section of the jet of FIG. 1 with baffle 50 installed adjacent the venturi exit and approximately centered on the axis of the venturi passage 21. Baffle 50 may be a cylinder with its axis perpendicular to the axis of the venturi passage 21 and approximately perpendicular to the plane of the drawing, or it may be a flat plate as shown in FIG.9 of Breen U.S. Pat. No. 2,852,906. When such baffle is fixed with relation to the jet, the distance between the end of the jet device and the baffle is preferably 0.05 to 0.15 inch (1.3 to 3.8 mm). The baffle is slidably mounted in bracket 41 which is in turn fixed to body 12. Thumb screw 42 holds baffle 50 in place in bracket 41 and when released the baffle can be moved from the exit end of the jet for ease of stringup, etc.

Figure 5:
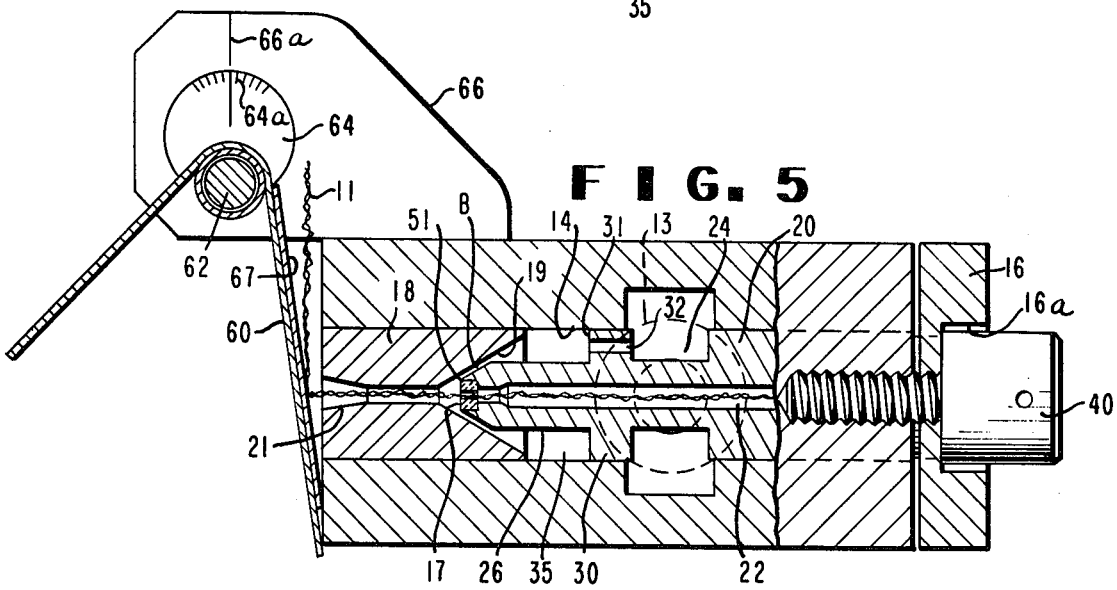
FIG. 5 is an enlarged section of FIG. 4 taken along line 5—5.
Figure 3:
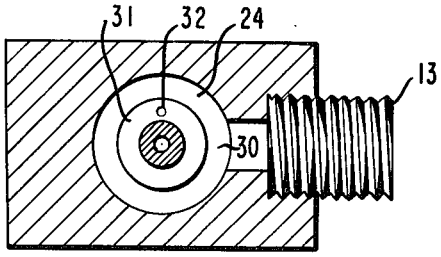
FIG. 3 is a vertical section of FIG. 2 taken along line 3—3.

FIGS. 4 and 5 show the jet 10 with baffle 60 movable about hinge pin 62 according to the teaching of Koslowski U.S. Pat. No. 3,835,510. Hinge pin 62 is mounted off-center of cylinder 64 which is rotatable in bracket 66 attached to jet body 12. Knob 65 is used to rotate cylinder 64 thus providing an eccentric motion for varying the position of baffle 60 for optimum operating conditions. Index marks 64*a* on cylinder 64 facilitate setting the baffle to optimum operating position. A layer of wear-resistant ceramic material 67 may be attached to the surface of baffle 60 facing the outlet end of the jet.

To string up the jet, yarn 11 is presented to the inlet end 15 of the jet 10. Compressed air is supplied to plenum 24 through inlet 13, then to bore 14 through orifice 32. The flange 16 is moved inwardly away from the head of bolt 40, i.e., from a preset operating position to a stringup position so that an aspirating effect draws the yarn 11 through the inlet 15 and out through passage 22. When the yarn emerges from the venturi 18, the flange is allowed to return to its preset operating position against bolt 40 under the force of air pressure against yarn needle 20 in the reduced region of the yarn needle opposite inlet 13. In this manner air pressure in communication with piston and cylinder arrangement of the yarn needle and jet body in chamber 24 is relied on to return the yarn needle back to the preset operating position after each stringup.

We claim:

1. In a yarn texturing jet including a body having yarn inlet and outlet ends connected by a central bore, means for introducing pressurized gas through a gas inlet into said bore between said ends, a venturi located in said bore at said outlet end, and a yarn guiding element extending into said bore from the yarn inlet end of the body, said element having a passage therethrough for guiding yarn from the yarn inlet of the body past the gas inlet through the exit end of said element to the venturi, said element having a cylindrical portion thereon approximating the diameter of said bore, said portion extending beyond said gas inlet and terminating in a surface facing and spaced from said venturi, there being an orifice in said portion in communication with said gas inlet and exiting at said surface for directing pressurized gas from said gas inlet into said venturi, and a baffle located adjacent the outlet end of the jet, said baffle being pivotably mounted to a hinge pin, the improvement comprising: said guiding element being axially slidable in said body from a preset operating position to a stringup position back to said preset operating position and being attached to a flange located outside the body at the inlet end of the body; means for limiting movement of said flange away from the inlet end of the body to said preset operating position; a reduced region in the cylindrical portion on said yarn guiding element in communication with the pressurized gas means and said hole both in said stringup position and in said preset operating position whereby pressurized gas returns the yarn guiding element to said preset operating position from said stringup position, a bracket attached to the outlet end of said jet; and a cylinder rotatably mounted in said bracket, said hinge pin being attached off-center of said cylinder whereby the position of said baffle with respect to said outlet end may be varied by an eccentric motion.

* * * * *